United States Patent [19]

Jeanjean et al.

[11] Patent Number: 4,829,149

[45] Date of Patent: May 9, 1989

[54] SULFUR HEXAFLUORIDE HIGH-TENSION CIRCUIT-BREAKER HAVING HIGH PERFORMANCE AT ANY TEMPERATURE

[75] Inventors: Robert Jeanjean, St-Lambert; Daniel Demissy, Montreal; Michel Landry, Ste-Julie, all of Canada

[73] Assignee: Cegelec Industrie Inc., Canada

[21] Appl. No.: 106,217

[22] Filed: Dec. 31, 1987

[51] Int. Cl.[4] ..... H01H 33/57

[52] U.S. Cl. ..... 200/148 E; 200/148 G

[58] Field of Search ..... 200/148 E, 148 G

[56] References Cited

U.S. PATENT DOCUMENTS 3,742,169 6/1973 Eggert ..... 200/148 E 4,698,468 10/1987 Pham ..... 200/148 E

FOREIGN PATENT DOCUMENTS 2825744 5/1979 Fed. Rep. of Germany ... 200/148 E

*Primary Examiner*—Robert S. Macon

*Attorney, Agent, or Firm*—Sughrue, Mion, Zinn, Macpeak & Seas

[57] ABSTRACT

In a sulfur hexafluoride high-tension circuit-breaker, a condenser/evaporator (8), disposed beneath and in communication with the inside of a support column, is partially filled with an insulating material (11), having at least one well (10) formed therein, with a heater element (9) being disposed inside the well, the surface of the insulating material (11) being connected to the bottom of the well via ducts (13, 14).

5 Claims, 1 Drawing Sheet

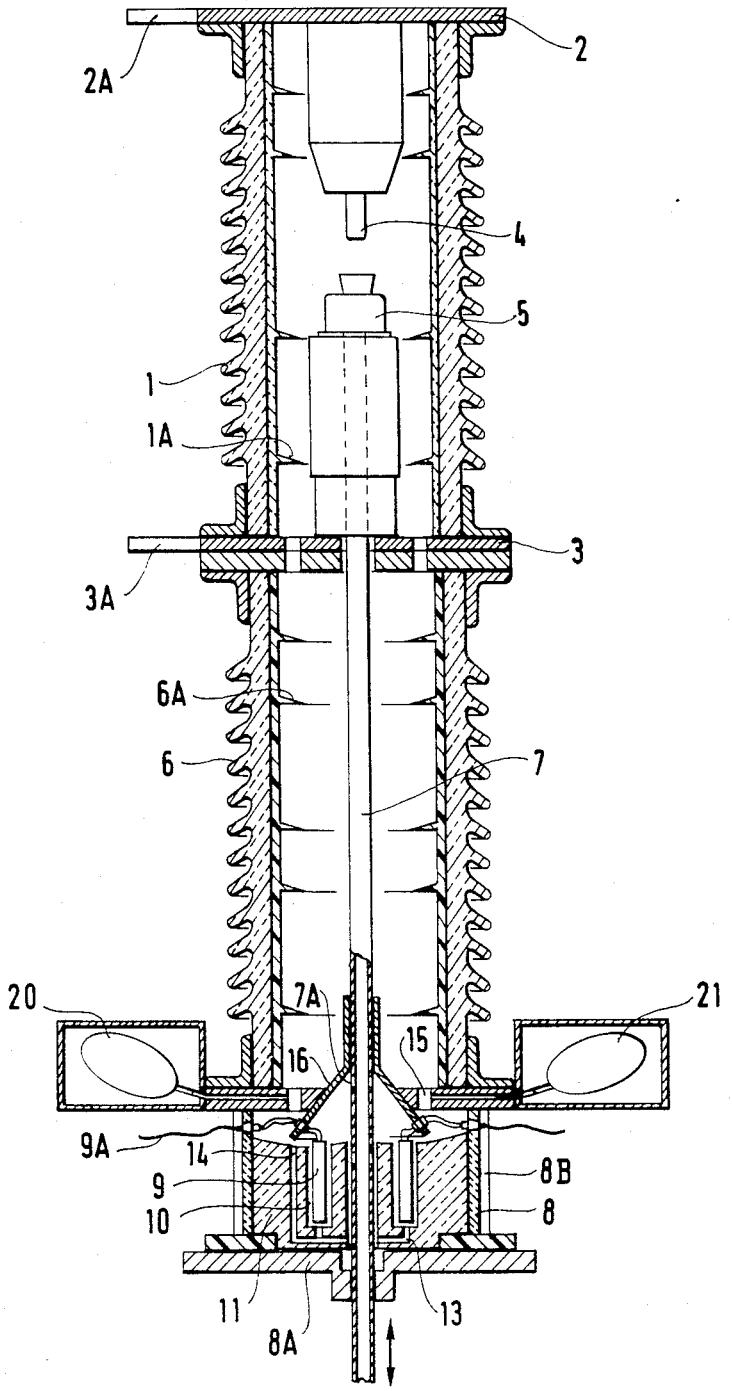
2A
2
4
5
1
1A
3
3A
6A
6
7
20
7A
21
16
15
9A
14
8B
9
10
8
11
13
8A

SULFUR HEXAFLUORIDE HIGH-TENSION CIRCUIT-BREAKER HAVING HIGH PERFORMANCE AT ANY TEMPERATURE

BACKGROUND OF THE INVENTION

The present invention relates to a sulfur hexafluoride high-tension circuit-breaker.

With such a circuit breaker, the pressure to which the circuit-breaker is filled at ambient temperature is of the order of a few bars (3 to 15 bars, for example).

When the outside temperature falls, the pressure inside the circuit-breaker also falls.

When the temperature reaches a certain lower threshold value, the gas begins to liquefy. As a result there is a reduction in the vapor pressure and a corresponding reduction in the quality of the insulation provided by the dielectric gas.

SUMMARY OF THE INVENTION

An aim of the present invention is to provide an $SF_6$ circuit-breaker having means for retaining its performance regardless of the temperature of the environment in wich the circuit-breaker is placed.

The present invention provides a sulfur hexafluoride hightension circuit-breaker comprising a circuit-breaking chamber in communication with and supported by a support column, characterized in that it includes a condenser/evaporator disposed beneath the support column and having its inside in communication with the inside of the support column and including heater elements disposed so that liquified sulfur hexafluoride coming into contact with the heater elements is vaporized.

BRIEF DESCRIPTION OF THE DRAWINGS

A preferred embodiment of the invention is described by way of example with reference to accompanying drawing, in which:

the sole FIGURE is an axial section through a sulfur hexafluoride high-tension circuit-breaker including means in accordance with the invention.

DETAILED DESCRIPTION OF THE INVENTION

The circuit-breaker in the figure comprises a cylindrical insulating envelope 1 capable of withstanding pressure, and closed at both ends by disks 2 and 3 provided with respective current terminals 2A and 3A. The envelope 1 delimits a circuit-breaking chamber including a set of fixed contacts 4 and a set of moving contacts 5.

The circuit-breaker also includes a support column 6 containing an operating rod 7 for transmitting motion from a drive member (not shown) to the set of moving contacts.

A condenser/evaporator 8 is placed beneath the support column and comprises a base 8A having the operating rod 7 passing therethrough in sealed manner and having a side wall 8B which may be provided with fins.

Resistor elements such as 9 fed with electrical current via connections 9A are disposed inside the condenser evaporator 8.

In accordance with the invention, the resistor elements are constituted and disposed in such a manner that the liquefied gas coming into contact therewith is immediately evaporated. In the example shown in the figure, the resistor elements 9 are cylindrical and are disposed in a well 10 provided in insulating material 11 which partially occupies the volume 8.

The space between the well and the heater element is small enough for any liquid which penetrates therein to have a large area of heat exchange with the resistance. As a result, the liquid is immediately vaporized.

The bottom of the well is connected to the surface of the material 11 by ducts 13 and 14.

The condenser/evaporator 8 and the support 6 communicate via orifices 15 made through the bottom of the support.

In a particular embodiment, as shown in the figure, the operating rod is hollw and includes holes such as 7A.

With a hollow rod, a conical pouring surface is disposed in the top portion of the chamber 8.

The operating rod is hollow and includes holes such as 7A.

The envelopes 1 and 6 are provided with internal fins 1A and 6A whose function is explained below.

The circuit-breaker operates as follows:

It is recalled that the theory of the invention is based on evaporating the liquid $SF_6$ which condenses in the condenser/evaporator 8 when the temperature reaches a certain low threshold. The apparatus is filled with sulfur hexafluoride ($SF_6$) at a pressure of 5 to 15 bars depending on its utilization. When the ambient temperature falls, the temperature inside the circuit-breaker also falls. When it reaches a value fixed by the liquid/vapor equilibrium curve, the $SF_6$ gas condenses preferentially on the coldest parts of the circuit-breaker, i.e. in the condenser/evaporator 8 which has smaller thermal inertia than the insulating envelope.

At a predetermined temperature, a calibrated thermostat switches on the heater elements 8.

The first drops of liquid $SF_6$ pass through the orifices 15 and slide over the pouring surface 16, thereby reaching the heater elements, and by virtue of the energy/volume ratio of the liquid, these drops are rapidly transformed into vapor, thereby maintaining the vapor pressure.

If the outside temperature continues to fall, excess liquid accumulates in the condenser/evaporator, but this time under the effect of gravity since the coldest point then becomes the top portion of the circuit-breaker. The ducts 13 and 14 serve to fill the well 10 from its bottom up.

The fins 1A and 6A prevent liquid flowing down the inside walls of the corresponding chambers. They increase the leakage path and avoid preferred paths arising on the surfaces of the envelopes due to pollution.

The fins 1A are made of insulating material; the fins 6A may be made of insulating material or of conducting material.

The heating liquid is thus vaporized. The process of rendering the gas temperature uniform is favored by the presence of the hollow insulating rod which thus acts as a thermo-siphon.

Further, the circuit-breaker in accordance with the invention may be equipped with a variable volumen flexible bag system. Inside a metal box 20, the pressure is raised to a predetermined pressure and an envelope 21 of extensible material is provided which is put into communication with the circuit-breaker chamber. When the pressure inside the circuitbreaker is greater than the pressure in the metal box (e.g. at 20° C.) the flexible bag occupies its maximum volume. This has the effect of storing a very large mass of $SF_6$.

When the temperature reaches the liquefying point, this mass of $SF_6$ condenses into liquid and is used by the evaporator to maintain the vapor pressure in the circuit-breaker.

Further, if the pressure in the metal box which is slightly greater than the vapor pressure of the gas in thermal equilibrium is added in, the volumne of the flexible bag becomes zero and the density of the $SF_6$ inside the circuit-breaker chamber increases.

It is thus possible to maintain high vapor pressure inside the chamber of the circuit-breaker by vaporizing a large quantity of liquid even when the outside temperature is very low, e.g. −50° C., while using very low heater power.

We claim:

1. A sulfur hexafluoride high-tension circuit-breaker comprising a circuit-breaking chamber in communication with and supported by a support column,, characterized in that it includes a condenser/evaporator (8) disposed beneath the support column (6) and having its inside in communication with the inside of the support column and including heater elements (9) disposed so that liquefied sulfur hexafluoride coming into contact with the heat elements is vaporized, the condenser/evaporator (8) being partially filled with an insulating material (11) having at least one well (10) formed therein, with the heater element (9) being disposed inside the well, the surface of the insulating material (11) being connected to the bottom of the well via ducts (13, 14).

2. A circuit-breaker according to claim 1, including a control rod (7) which is hollow and provided with lateral orifices (7A) putting the inside of the control rod into communication with the inside of the condenser/evaporator (8).

3. A circuit-breaker according to claim 2, characterized in that the inside of the circuit-breaker is connected to a variable volume (21) that varies with the outside temperature.

4. A circuit-breaker according to claim 3, characterized in that the variable volume (21) is in the form of a flexible bag placed in a pressurized box (20) disposed outside the circuit-breaker.

5. A circuit-breaker according to claim 1, characterized in that the inside of the circuit-breaker is connected to a variable volume (21) that varies with the outside temperature.

* * * * *

UNITED STATES PATENT AND TRADEMARK OFFICE

CERTIFICATE OF CORRECTION

PATENT NO. : 4,829,149

DATED : May 9, 1989

INVENTOR(S) : Robert Jeanjean, Daniel Demissy, Michel Landry

It is certified that error appears in the above-identified patent and that said Letters Patent is hereby corrected as shown below:

Page 1 (Cover Page) change "Filed: Dec. 31, 1987" to --Filed: October 9, 1987--.

Signed and Sealed this

Thirtieth Day of January, 1990

*Attest:*

JEFFREY M. SAMUELS

*Attesting Officer*

*Acting Commissioner of Patents and Trademarks*